US009297135B2

(12) United States Patent
Suazo

(10) Patent No.: US 9,297,135 B2
(45) Date of Patent: Mar. 29, 2016

(54) STRUCTURAL LINING SYSTEM

(71) Applicant: FastDitch, Inc., Espanola, NM (US)

(72) Inventor: Kenneth L. Suazo, Espanola, NM (US)

(73) Assignee: FAST DITCH, INC., Es Panola, NM (US)

( * ) Notice: Subject to any disclaimer, the term of this patent is extended or adjusted under 35 U.S.C. 154(b) by 0 days.

(21) Appl. No.: 14/683,365

(22) Filed: Apr. 10, 2015

(65) Prior Publication Data

US 2015/0322638 A1 Nov. 12, 2015

Related U.S. Application Data

(60) Provisional application No. 61/990,815, filed on May 9, 2014.

(51) Int. Cl.
*E02B 5/02* (2006.01)
*E02B 13/00* (2006.01)
*E02B 5/00* (2006.01)

(52) U.S. Cl.
CPC ... *E02B 5/02* (2013.01); *E02B 5/00* (2013.01); *E02B 13/00* (2013.01)

(58) Field of Classification Search
CPC ..... E02B 5/00; E02B 5/02; E02B 13/00; E03F 3/046; E03F 5/0401
USPC ..... 405/118
See application file for complete search history.

(56) References Cited

U.S. PATENT DOCUMENTS 195,989 A 10/1877 Culver
210,442 A 3/1878 Page
856,702 A 6/1907 Howley
980,442 A 1/1911 Schlafly
1,515,709 A 11/1924 Stowell
2,582,515 A 1/1952 Warp
2,657,074 A 10/1953 Schwester et al.
3,113,435 A 12/1963 Yount
3,156,099 A * 11/1964 Dailey ..... E02B 13/00 24/DIG. 50
3,313,319 A 4/1967 Osborn et al.
3,315,704 A 4/1967 Shire
3,336,950 A 8/1967 Fochler
3,374,634 A 3/1968 Fochler
3,383,863 A 5/1968 Berry
3,417,570 A 12/1968 Pegan
3,446,025 A 5/1969 Koch
3,597,928 A 8/1971 Pilaar
3,611,731 A 10/1971 Edmondson
3,731,711 A 5/1973 Bauer
3,735,596 A 5/1973 Stephenson
3,854,292 A 12/1974 Nienstadt
3,878,685 A 4/1975 Schmunk (Continued)

*Primary Examiner* — Frederick L Lagman
(74) *Attorney, Agent, or Firm* — Dennis F. Armijo

(57) ABSTRACT

A lining system for a ditch or canal constructed with tight tolerances so a gasket is not required to connect liner channel sections. Each channel liner has a female slot on a first end and a male protrusion on a second end for adjoining channel liners. Flushing strips with male protrusions are installed in female slots in between channel beams. Flushing strips with variable Manning coefficients can be inserted based on a user's needs. Self-anchoring tabs can be inserted into anchoring slots on the outside of liner channels for anchoring the liner by soil compaction. Elbow sections can be used to change the direction of flow of the liquid. Elbow sections are adjoined to a liner channel similar to the adjoinment of in series channel liners to result in a desired angle for the change in direction.

20 Claims, 15 Drawing Sheets

(56) References Cited

U.S. PATENT DOCUMENTS

| | | | |
|---|---|---|---|
| 3,897,090 | A | 7/1975 | Maroschak |
| 3,926,222 | A | 12/1975 | Shroy et al. |
| 3,958,425 | A | 5/1976 | Maroschak |
| 4,065,924 | A | 1/1978 | Young |
| 4,190,988 | A | 3/1980 | Carreiro |
| 4,257,716 | A | 3/1981 | Woodrow |
| 4,405,264 | A | 9/1983 | Brady et al. |
| 4,765,775 | A | 8/1988 | Kroger |
| 4,787,776 | A | 11/1988 | Brady et al. |
| 5,015,122 | A | 5/1991 | Combes |
| 5,038,528 | A | 8/1991 | Brant |
| 5,193,588 | A | 3/1993 | Kanao |
| 5,288,168 | A | 2/1994 | Spencer |
| 5,316,175 | A | 5/1994 | Van Romer |
| 5,548,931 | A | 8/1996 | Bryant |
| 5,558,464 | A | 9/1996 | Tassone et al. |
| 5,669,733 | A | 9/1997 | Daley et al. |
| 5,685,668 | A | 11/1997 | Justice |
| 5,689,920 | A | 11/1997 | Hallsten |
| 5,806,252 | A | 9/1998 | Scuero |
| 5,810,511 | A | 9/1998 | Schmidt |
| 5,820,296 | A | 10/1998 | Goughnour |
| 5,924,461 | A | 7/1999 | Shaw et al. |
| 5,972,468 | A | 10/1999 | Welch et al. |
| 6,092,686 | A | 7/2000 | Shaw et al. |
| 6,141,916 | A | 11/2000 | Shackelford |
| 6,187,244 | B1 | 2/2001 | Fishel et al. |
| 6,202,358 | B1 | 3/2001 | Janesky |
| 6,227,763 | B1 | 5/2001 | Kuhns |
| 6,273,640 | B1 | 8/2001 | Suazo |
| 6,310,284 | B1 | 10/2001 | Ikeda |
| 6,361,248 | B1 | 3/2002 | Maestro |
| 6,450,458 | B1 | 9/2002 | Bernard |
| 6,634,144 | B1 | 10/2003 | Moore et al. |
| 6,692,186 | B1 | 2/2004 | Suazo |
| 6,698,975 | B1 | 3/2004 | Benecke |
| 6,722,818 | B1 | 4/2004 | Suazo |
| 6,755,596 | B2 | 6/2004 | Schibi |
| 6,766,817 | B2 | 7/2004 | Silva |
| 6,817,807 | B1 | 11/2004 | Charon |
| 6,880,720 | B2 | 4/2005 | Van Romer |
| 7,025,532 | B2 | 4/2006 | Suazo |
| 7,156,580 | B2 | 1/2007 | Suazo |
| 7,165,914 | B2 | 1/2007 | Suazo |
| 7,226,241 | B2 | 6/2007 | DiTullio |
| 7,306,401 | B1 | 12/2007 | Linkogle |
| 7,357,600 | B2 | 4/2008 | Suazo |
| 7,470,085 | B1 | 12/2008 | Suazo |
| 7,611,129 | B1 | 11/2009 | Stahm |
| 7,758,282 | B2 | 7/2010 | Suazo |
| 8,439,602 | B1 | 5/2013 | Suazo |
| 2001/0032418 | A1 | 10/2001 | Richardson |
| 2004/0096276 | A1 | 5/2004 | Startteim et al. |
| 2004/0202510 | A1* | 10/2004 | Suazo ..... E02B 5/02 405/118 |
| 2005/0025572 | A1 | 2/2005 | Sanfillippo et al. |
| 2005/0186031 | A1* | 8/2005 | Suazo ..... E02B 13/00 405/121 |
| 2005/0196590 | A1 | 9/2005 | Seth et al. |
| 2005/0271473 | A1 | 12/2005 | Charon |
| 2006/0159520 | A1 | 7/2006 | Charon |
| 2009/0067928 | A1 | 3/2009 | Currivan |
| 2009/0103982 | A1 | 4/2009 | Hodgekins et al. |
| 2011/0135392 | A1 | 6/2011 | Zajicek et al. |
| 2011/0318109 | A1 | 12/2011 | Miller et al. |
| 2012/0189810 | A1 | 7/2012 | Whitener |
| 2013/0048630 | A1 | 2/2013 | Zajicek et al. |

* cited by examiner

STRUCTURAL LINING SYSTEM

RELATED APPLICATIONS

The present application claims priority to U.S. Provisional Application No. 61/990,815, filed May 9, 2014, assigned to Assignee hereof, and the specification of which is incorporated herein by reference.

BACKGROUND OF THE INVENTION

1. Field of the Invention (Technical Field)

The present invention relates to a fluid transport lining system and more particularly to a variable Manning coefficient liner system, a gasket free liner adjoining system, system and a novel elbow system for changing the direction of the flow of liquids.

2. Background Art

Ditches formed in the earth for conveying water to a point or to an area of use have been common throughout the world for generations. Earthen ditches have been used to transport potable water, irrigation water, and other fluids and materials. Earthen irrigation ditches continue to be significant in the transportation of water because they are readily and inexpensively formed in almost any terrain.

The term "ditch" as used in this document means any excavation dug in the earth, or any structure partially or completely installed above earth, that may be referred to as a drain, channel, canal or acequia, whether lined or unlined, usually but not always relying primarily on gravity to transport fluids and materials along descending elevations.

During transportation of water through earthen ditches that are unlined by a material other than dirt ("unlined ditches"), significant quantities of that ever more precious commodity, water, are lost because of seepage, erosion, trans-evaporation, and other causes. Tests indicate that as much as 80-90% of water may be lost during transportation through an unlined earthen ditch before water is delivered to a point or area for application and use.

It should be appreciated that loss of water, referred to as "seepage loss," may be considerable. At least one report issued by New Mexico State University entitled "Field/Laboratory Studies for the Fast Ditch Lining System," dated Feb. 10, 2002, ("Report") indicates the results of tests conducted over a nine day interval. Total water losses during the nine-day test period were estimated to be 14,245,010 gallons, or 85.8% of total flow, when water was conducted through an unlined earthen ditch. The Report attributes most water losses to existing vegetation overgrowth, tree root systems, gopher holes, evaporation, and seepage or percolation. On the other hand, that same report, based on field measurements taken with a liner system disclosed in at least one of the Fast Ditch Patents and Applications (a term defined below) that had been installed in the same earthen ditch showed a total loss of only 7.3% of total flow.

Unlined earthen ditches must be regularly maintained, cleaned, and repaired to avoid loss of water through wall collapse; accumulated debris, absorption through dirt walls, capillary action, and rodent activity, are among many causes of ditch deterioration. Because repair and maintenance of unlined ditches is costly and labor intensive, various methods for lining unlined ditches have been suggested. Those methods include use of concrete, metal, and polyvinyl chloride materials. Those suggestions; however, have proven inadequate for a number of reasons including at least cost and unresponsiveness to modern environmental concerns. Some materials, like concrete, are difficult to install in remote geographical areas, are inflexibly positioned once installed, and often require major construction efforts that are neither practical nor affordable based on cost-benefit analyses.

Exemplary solutions to problems associated with lining, both lined and unlined ditches, are provided in the following patents and patent applications by one or more of the inventors named in connection with this document: U.S. Pat. No. 6,273,640 issued Aug. 14, 2001; U.S. Pat. No. 6,692,186 issued Feb. 17, 2004; U.S. Pat. No. 6,722,818 issued Apr. 20, 2004; U.S. Pat. No. 7,025,532 issued Apr. 11, 2006; U.S. Pat. No. 7,165,914 issued Jan. 23, 2007; U.S. Pat. No. 7,156,580 issued Feb. 2, 2007; U.S. Pat. No. 7,357,600 issued Apr. 15, 2008; U.S. Pat. No. 7,470,085 issued Dec. 30, 2008; application Ser. No. 12/100,829 filed Apr. 10, 2008; and U.S. Pat. No. 8,439,602 issued May 14, 2013.

As can be seen, there are presently several lining systems in the prior art. However, the embodiments disclosed herein constitute significant and novel improvements over these prior art systems. The main purpose of the prior art patents was to provide for a light weight, flexible liner that could be installed with simple tools into an existing or newly excavated trench to provide a system that was water tight for applications in irrigation and storm water management. The original designs were to join multiple corrugations together to form straight sections that could be connected together with a nested connection utilizing a foam gasket or the like for flexibility to form a liquid transportation system.

Several iterations of the designs were implemented to improve flow characteristics, water tightness in the nested connection and flexibility. All the design changes were made to accommodate the thermo-forming manufacturing process.

The first consideration in the new design is to develop a system that can be manufactured utilizing the injection molding process. The second consideration is for an easy and stackable transport system for the molded sections. Finally, the molded sections must not include too many variable molded parts to keep down the complexity and expense of the system.

The injection molding process yields a product that has high tolerances, and therefore can achieve a watertight seal without the use of a foam or rubber gasket. Thermo-forming provides for low manufacturing tolerances that require additional elements or manipulation to prevent leakage.

Also, given the characteristics of the thermos-forming process, the draw depth of the tool yielded parts that were inconsistent in wall thickness leaving the corrugations thin and inconsistent in the valleys, rendering the overall part venerable to puncturing given live loading situations such as animals walking in the channel, installation in hot temperatures, and brittleness in cold temperatures.

The use of corrugations in the prior art and previous patents was solely for making the straight section flexible for subtle changes in direction during installation. The focus of the design was to ensure the corrugations were tali enough to provide flexibility without increasing the Manning's coefficient of friction. Once the design of the corrugation was constructed, the Manning's coefficient of friction was fixed for that specific corrugation design.

SUMMARY OF THE INVENTION

Disclosure of the Invention

The presently claimed invention considers and overcomes the shortcomings and deficiencies in the thermoformed manufactured components that comprise the overall systems of prior art. This new and novel design also overcomes the shortcomings of the prior art by incorporating inverted structural channels connected with slots to provide a rigid section that will carry a heavier structural load without collapsing. The use of corrugations for flexibility is not required since the use of a structural elbow is utilized in the new design to make subtle or dramatic changes in the lateral direction, utilizing a series of connectable elbows, in installation. The inverted channel design provides a preformed camber in the inverted channel for the purpose of material deflection under dynamic and static loading conditions. Enhancing the channel is a molded structural honeycomb webbing, or the like for the purpose of load distribution to improve puncture shear.

The Manning's coefficient is no longer fixed by the design of the corrugations height and width as in prior art. The new design implements a flushing or friction strip to provide a wide range of Manning's friction values, dependent on end users' needs. Once the evaluated slope and flow are calculated the insertable flushing strips for high efficiency flow rates can be inserted into female slots during installation. Conversely, the variable height friction strip can be inserted into the female slots for high-energy dissipation applications. This provides for a variable Manning coefficient, selected by the user for multiple purposes such as water diversion, irrigation, and the like.

Connections of the straight formed sections now incorporate a tight tolerance male/female connection that eliminates the need for a collapsible foam or rubber gasket to ensure a water tight connection. These tight tolerance male/female connections can also be incorporated into fan shaped elbow sections, as discussed above. With this novel injection molding process, fewer parts are required for installation, and manipulation of the liner elements is minimized.

A new feature in the new design is the ability to provide an anchoring tab that can be inserted at the bottom of the trapezoidal section on either side in the slots provided. The purpose is to provide a self-securing feature that will anchor the liner in place with the use of backfill earthen material. In this manner, the weight of the backfill material will fill in the volume/space between the inverted channels on the insert tab securing the liner in place.

Unique elbow panels are provided for universal use in changing the direction of the flow of liquid such as water. Each elbow panel provides for a predetermined angle, such as 11¼°, which can be joined with one or more similar elbow panels to change the direction to a desired angle. In this example, eight elbow panels would be required to provide a 90° turn. The elbow panels are joined similarly to the lining panels, thus requiring no additional elements such as gaskets of foam to provide a leak proof seal.

A primary object of the present claimed invention is to provide a lining system that does not require gaskets for a leak proof seal. Another object is to provide a lining system that can be adjusted to vary the Manning coefficient so the same liner system can be used for varying flow conditions as opposed to fixed systems for particular flows. Another object is to provide unique elbow elements to a liner system for altering the direction of flow.

Other objects, advantages, and novel features, and further scope of applicability of the presently claimed invention will be set forth in part in the detailed description to follow, to be taken in conjunction with the accompanying drawings, and in part will become apparent to those skilled in the art upon examination of the following, or may be learned by practice of the claimed invention. The objects and advantages of the presently claimed invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the presently claimed invention and, together with the description, serve to explain the principles of the claimed invention. The drawings are only for the purpose of illustrating a preferred embodiment of the claimed invention and are not to be construed as limiting the claimed invention. In the drawings:

DESCRIPTION OF THE PREFERRED EMBODIMENTS

Best Modes for Carrying Out the Invention

Figure 1:
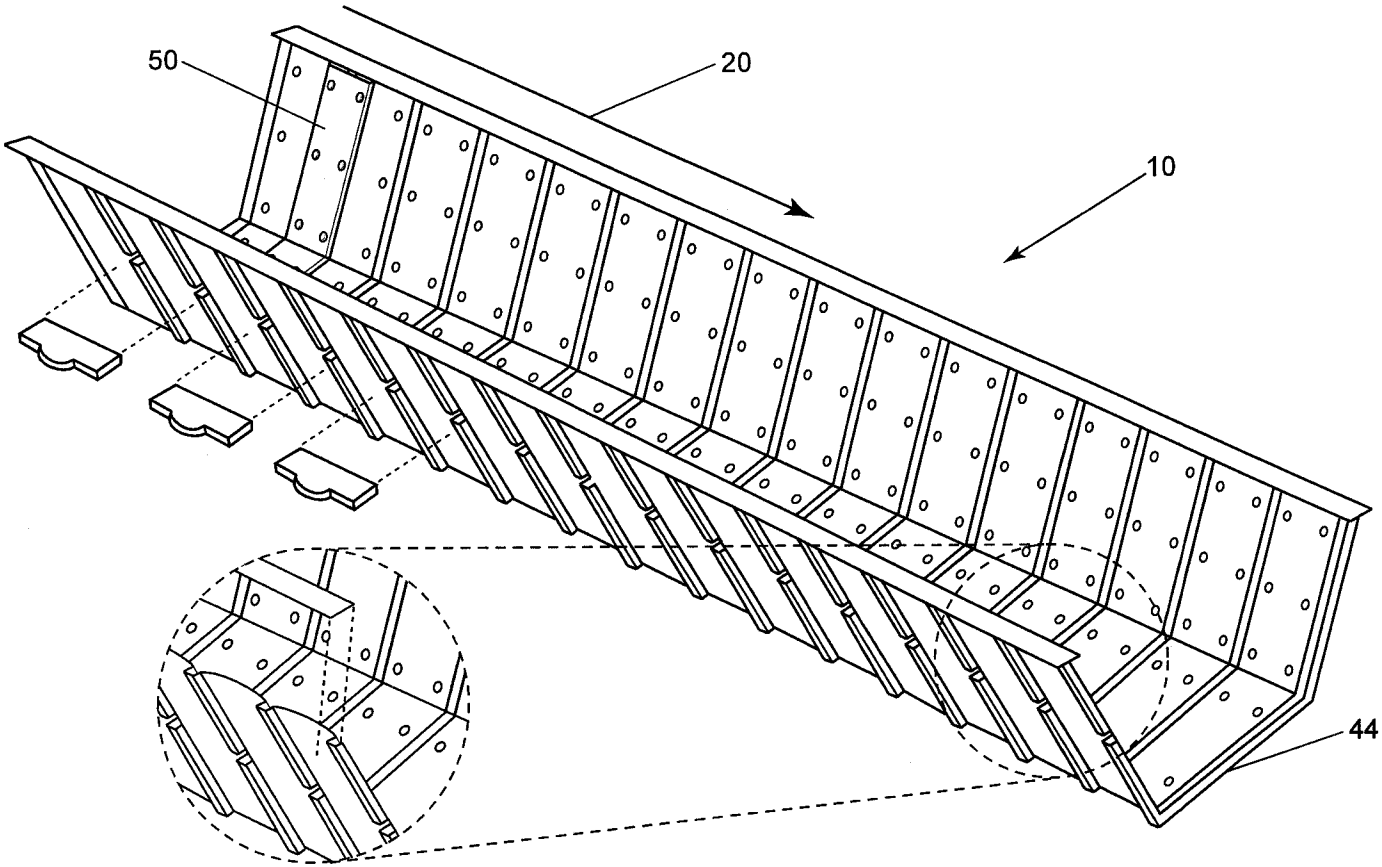
FIG. 1 shows a perspective view of the injection molded liner system.
Figure 2:
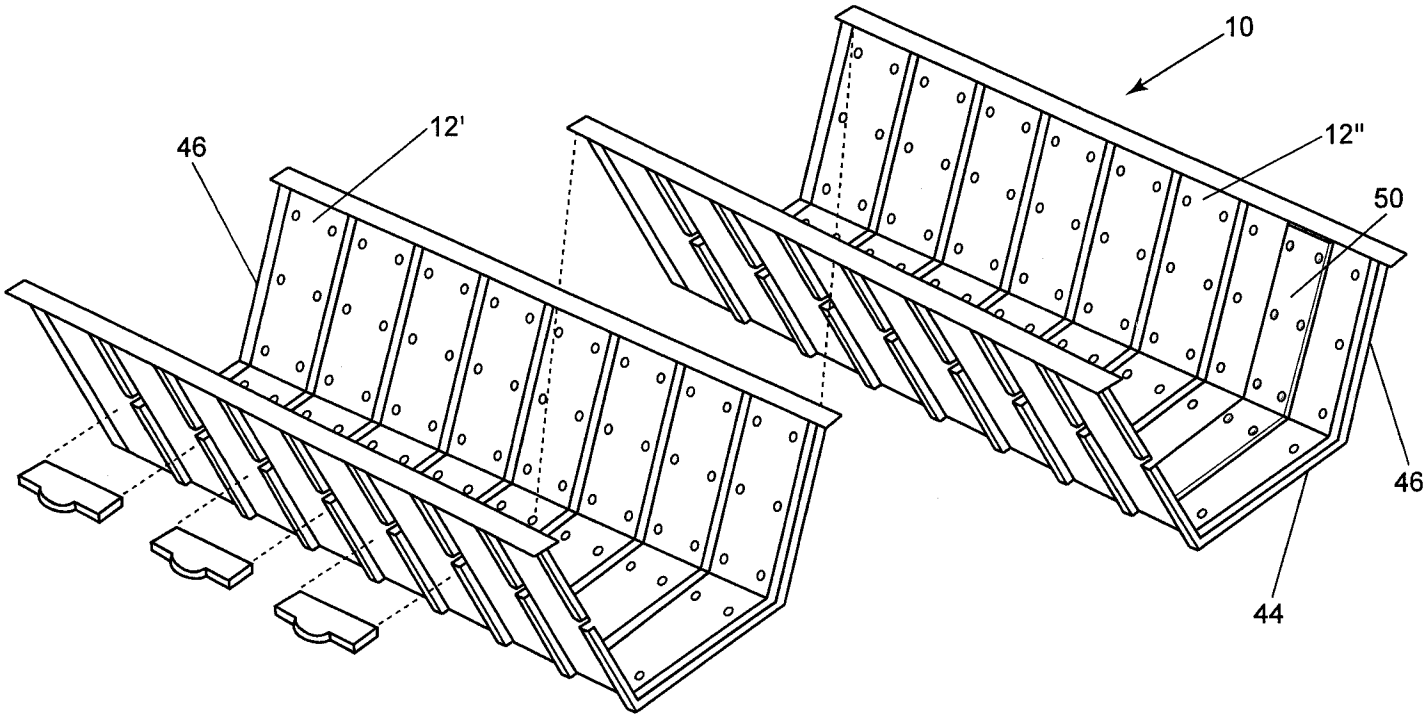
FIG. 2 shows an exploded view of two inverted liner channels that make up the system of FIG. 1.

The structural lining system is comprised of a series of connected inverted channels with a trapezoidal cross section. The preferred structural liner system 10 is shown in FIGS. 1 and 2. FIG. 2 shows the liner system 10 of FIG. 1 comprised of a first liner channel 12' affixed to a next liner channel 12". Liner channels 12 are similarly affixed in series to a preferred length. Each liner channel 12 is constructed using an injection molding process which provides for tighter tolerances than a thermoformed process. By using the injection molding process, fewer components are required to be manufactured and used in construction of a lining system. Due to the tighter tolerances, the junction between a first liner channel 12' and next liner channel 12" can be abutted without a gasket or the like to form a water tight seal. The injection molded components, liner channels 12, and elbows 114, can be stacked or nested for minimizing transport space and transportation costs.

Figure 5A:
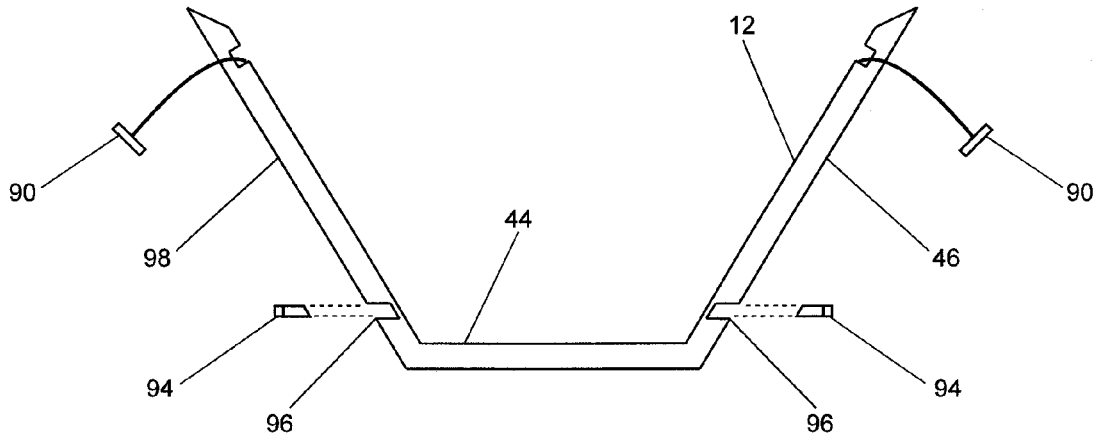
FIG. 5A shows a front view of the preferred molded liner system of FIGS. 1 and 2.
Figure 5B:
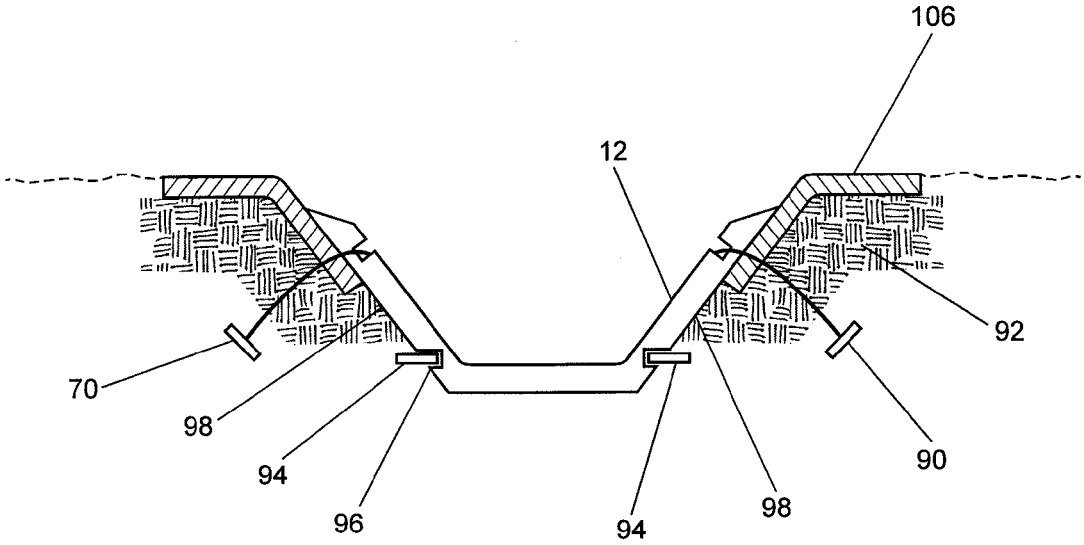
FIG. 5B shows the molded liner system of FIG. 5A mounted to a ground surface.
Figure 5C:
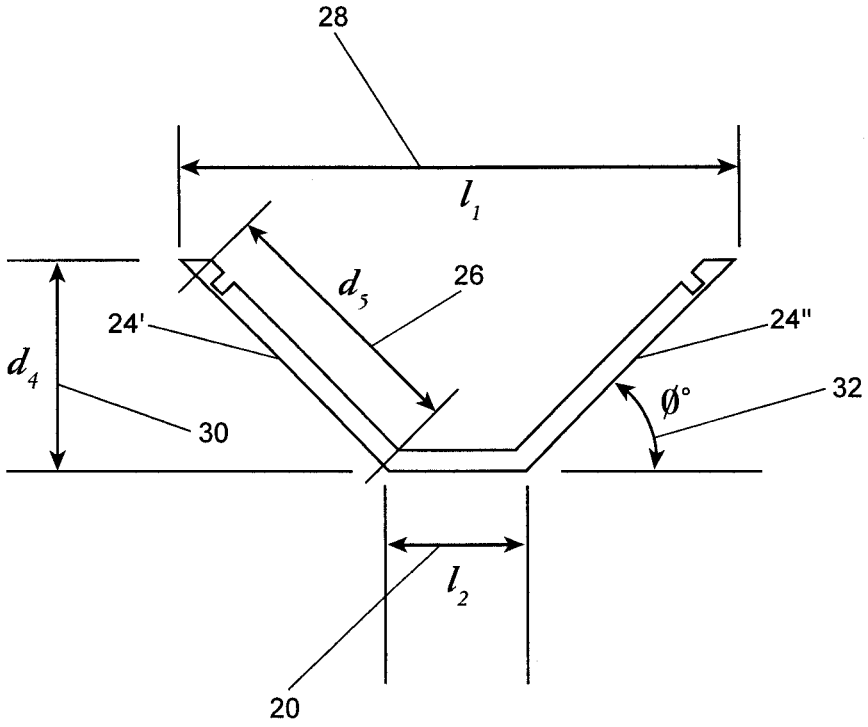
FIG. 5C dimensionally shows the molded liner system of FIG. 5A.
Figure 6:
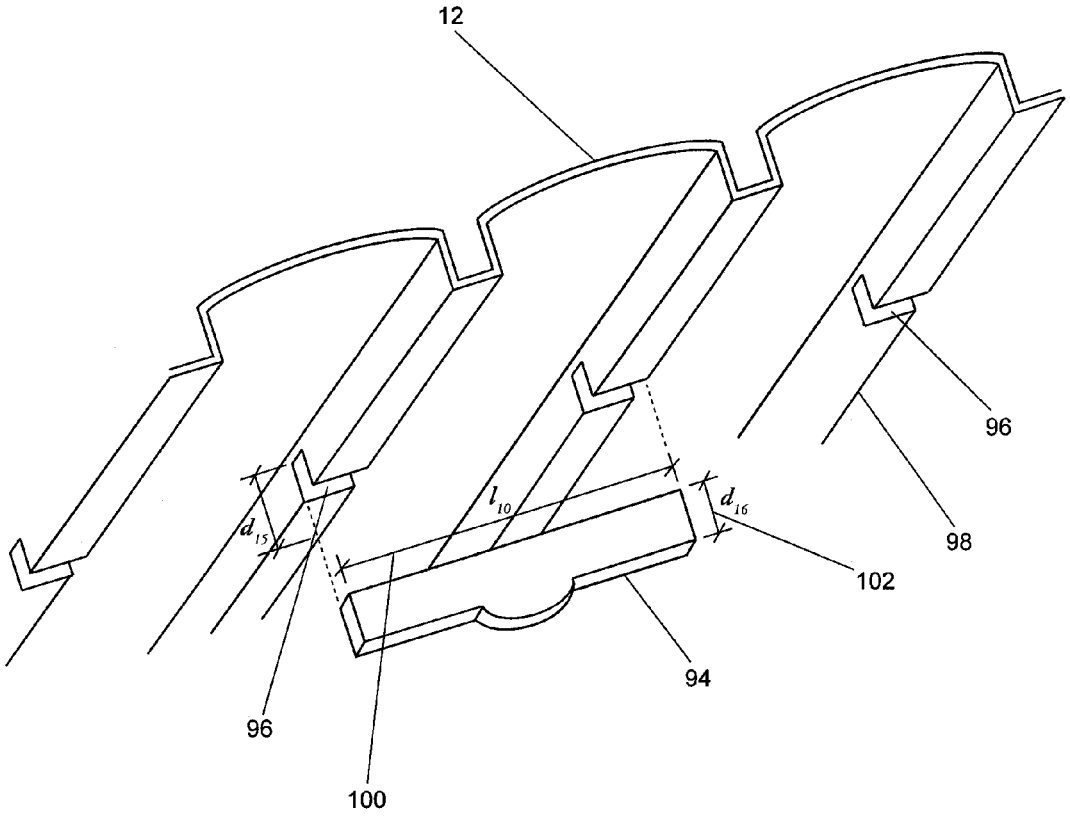
FIG. 6 shows the preferred method of affixing the anchoring tab to a channel liner.
Figure 7:
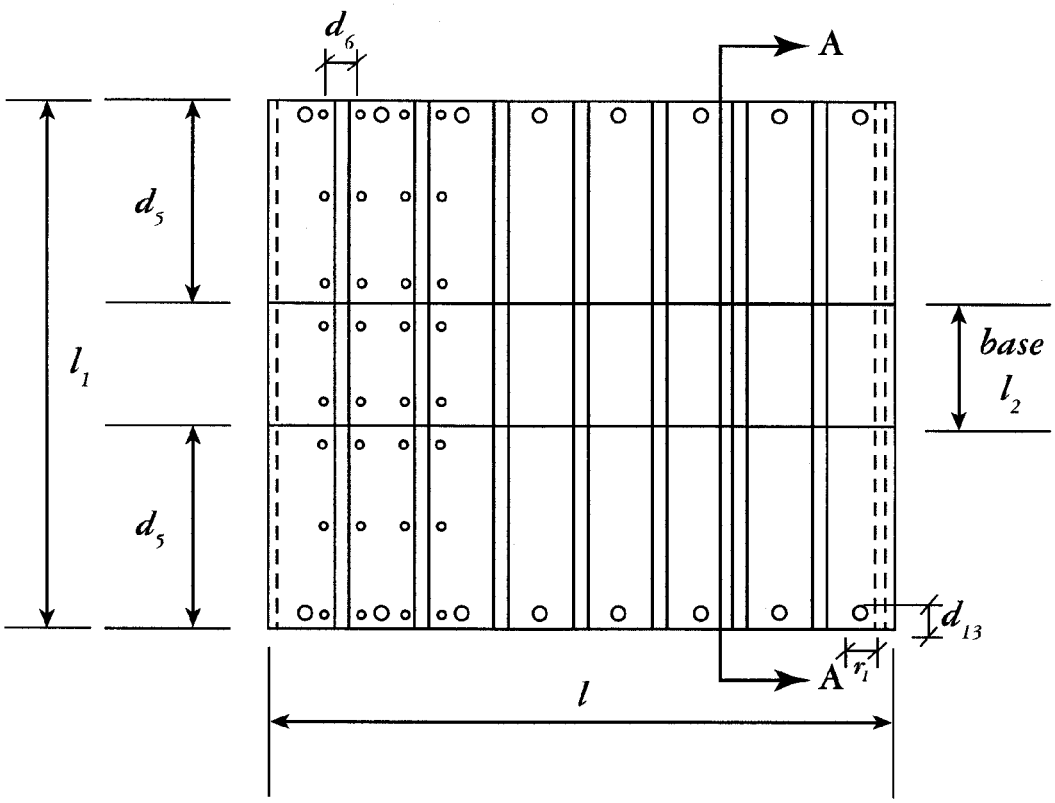
FIG. 7 shows a top view of the preferred channel section.
Figure 8:
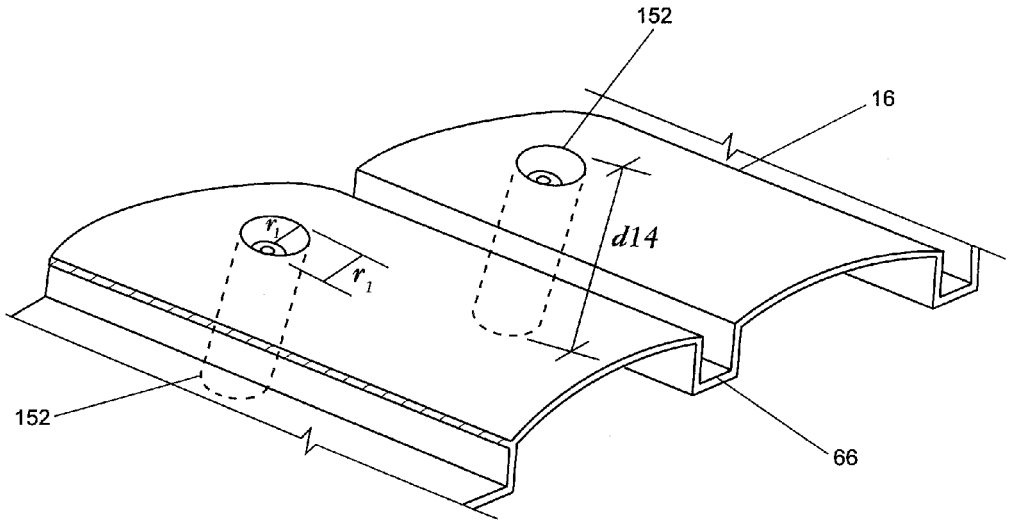
FIG. 8 shows a close up view of a liner section showing a method of affixing earth anchors in anchor ports.

As shown in FIGS. 5C, 7 and 8, each channel liner 12 is a structurally straight component comprised of multiple structural, inverted channel beams 16 with female slots 18 on either side. Channel beams 16 are configured such that channel beams 16 are transverse to the flow of the liquid 20 in channel liner 12. As shown in FIG. 5C, the geometry is such that multiple channel beams 16 form a base 20, having a length l2 20, and two sides 24' and 24", forming a trapezoidal configuration, with a wall length of d5 26, and a top opening throat length l1 28. Throat width l1 28, is a function of the height d4 30, and angle theta 32 from the horizontal axis.

Figure 9:
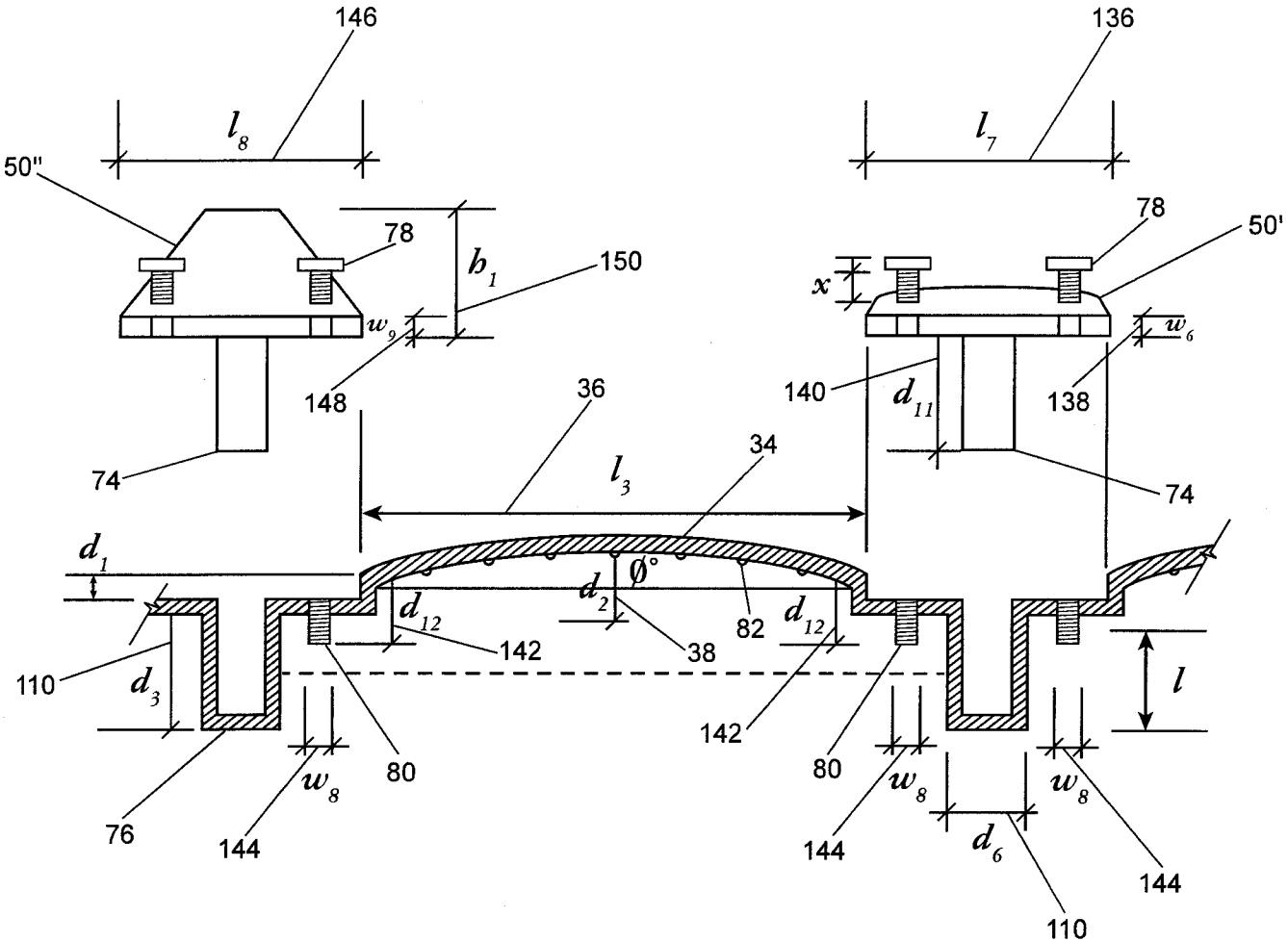
FIG. 9 dimensionally shows a liner channel and a method of affixing flushing strips to the liner channel.

As shown in FIG. 9, each individual channel 34 with a given length l3 36 is concave, having a depth defined by d2 38. The concave configuration of channel 34 provides deflection for the flowing fluid and debris that also supports greater loading capabilities from static or dynamic loads from fluids and debris, and other live loads or dead loads.

Figure 10:
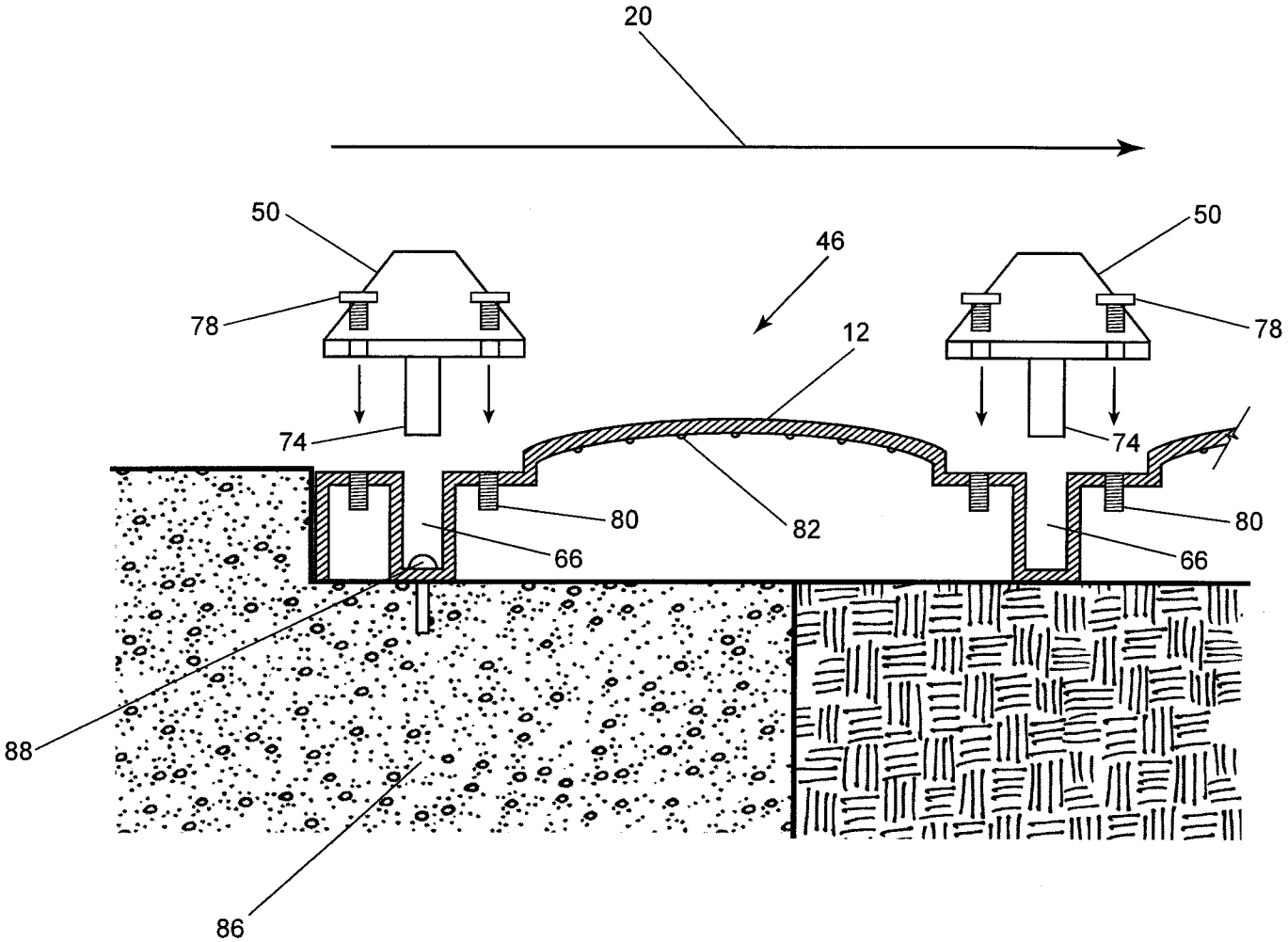
FIG. 10 shows a liner channel affixed to differing types of ground materials.
Figure 11:
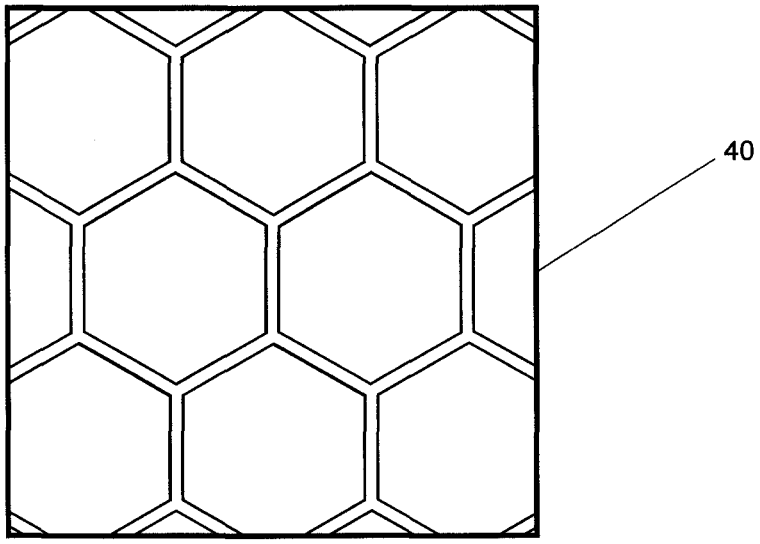
FIG. 11 shows a honeycomb type of configuration for providing rigidity to the liner channels.

Bottom side 82 of straight liner section 44 having the multiple inverted channels 34 connected series, can have a structural honeycomb configuration 40 as shown in FIGS. 10 and 11, or other similar structural configuration, molded into liner 46 to increase the inertia of the material to prevent puncture and brittleness.

Figure 4:
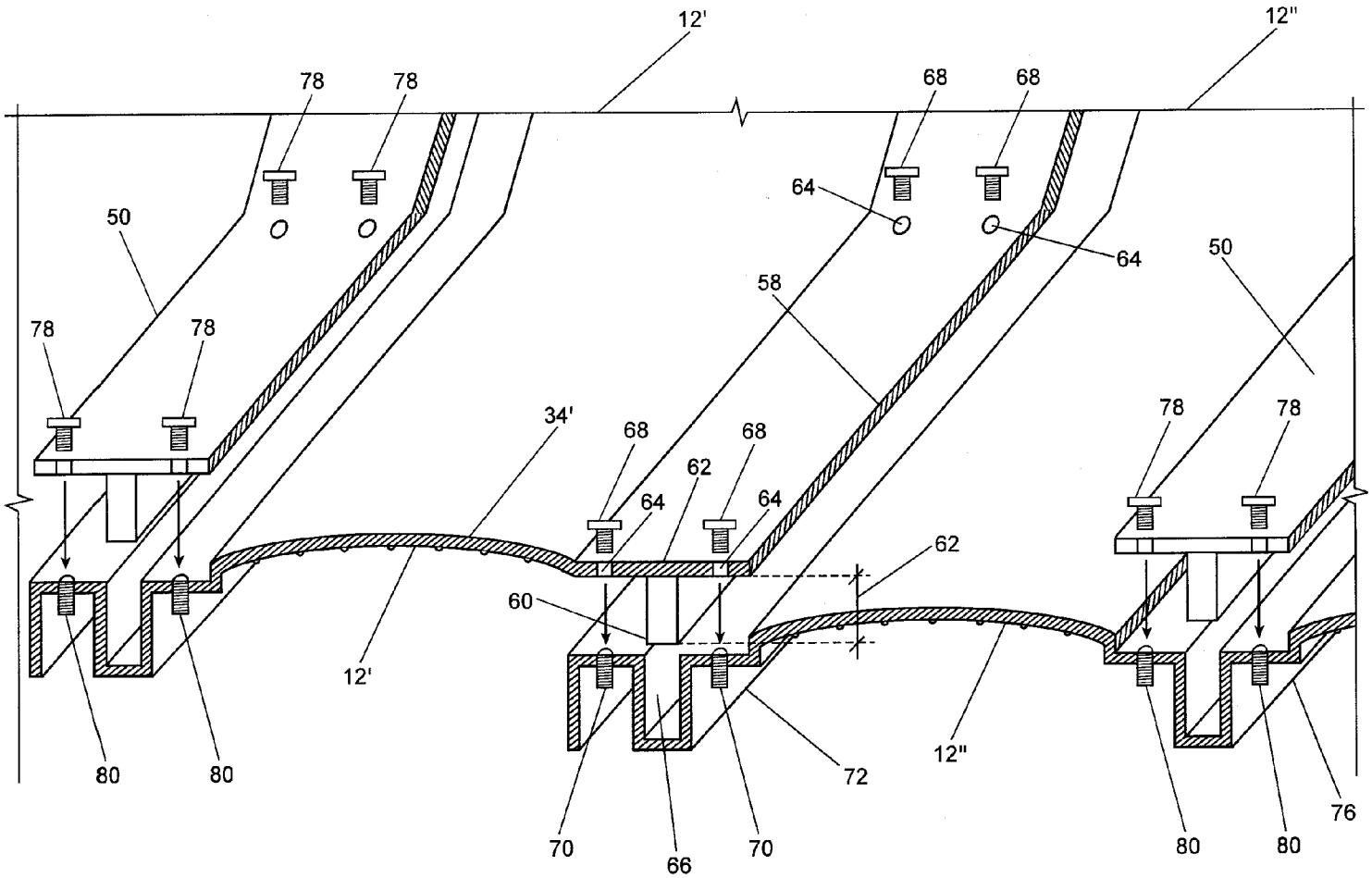
FIG. 4 shows the preferred seal between the inverted liner channels of FIG. 2 and the mounting method for the flushing strips of FIGS. 4A through 4D.

The preferred method of affixing first channel liner 12' to next channel liner 12" is shown in FIG. 4. Male end of channel liner 58 is configured such that the last inverted channel 34' will have a downward facing male protrusion 60 at the end of the last channel having a predetermined depth 62. Male protrusion 60 runs continuously from end to end, transverse to the longitudinal axis of the channel liner 12'. Male protrusion 60 functions as guide key 62 to align two channel liners 12' and 12" being joined together. Male protrusion guide key 62 has multiple fastener holes 64 on both sides of guide key running the entire length of male guide key 60 from end to end to ensure a leak tight connection.

As shown in FIG. 4, channel liner 12" has a female end of channel liner 72. On the back side of each female end channel liner 72 is a slot 66 that runs transverse to the length of the female end channel liner 72. Male protrusion 60 is configured to fit tightly into slot 66, thus, the method of adjoining first channel liner 12' to next channel liner 12", male protrusion 60 in inserted into slot 66 and bolts 68 are inserted into fastener holes 64 and tightened onto threaded apertures 70 until the bottom end of male key guide 62 is flush with top of female slot guide 66. The number of bolts 68, fastener holes 64, and threaded apertures can be varied and optimized depending on the amount of liquid being moved, the size of the liner, and the like. This method of adjoining channel liners 12 is repeated to the end of the ditch, as depicted in FIG. 1. Each channel liner 12 comprised of multiple structural inverted channels 16 will have a male end 58 and a female end 64 on opposing ends. Once multiple channel sections 12 have been joined together in trench/canal or structure, they can be secured in place by securing the system with anchor bolts 84 or fastening devices utilizing anchor apertures 152 in slots 66, as shown if FIGS. 8 and 10. Anchor aperture 152 has a radius r1 154 and depth of d14 156, as shown in FIG. 8.

Sections joined from end to end will form a channel for the purposes of transporting fluids from one location to another. Based on the engineering requirements for flow rates the liner may be comprised of variable height Manning's coefficient flushing strips. As depicted in FIGS. 3A, 3B, 3C, 3D, 4, and 9 the unique design includes flushing strips 50', 50", 50'", and 50"" of different configurations which are inserted into designed slots 66. The method of affixing flushing strips to liner channels 12 is similar to affixing first channel liner 12 to next channel liner 12", as discussed above. Each flushing strip 50 has a trapezoidal geometry similar to the geometry of channel liner 12 and will traverse continuously from one side to the other perpendicular to the longitudinal flow of the water in channel liner 12. Each flushing strip 50 has a flushing strip male protrusion 74 for insertion into flushing strip female slot guide 76. Flushing strip 50 is screwed into the screw bosses, via flushing strip bolts 78 and flushing strip threaded apertures 80, located in the female toric seal end connection. Between each concave inverted channel 16, flushing strip female slot guide 76 protrudes downward having a depth of d3 110, from the top side of the liner will run the length of channel liner 12, transverse to the longitudinal axis of channel liner 12 from end to end. Each flushing strip female slot guide 76 has a width of d6 110 and located between multiple inverted concave channels 16 within each channel liner. A close up view of this attaching mechanism is shown in FIG. 9. For further clarification, flushing strips 50 are shown in the embodiments of FIGS. 1 and 2.

Based on engineering requirements for high efficiency channel flow or low Manning's coefficient of friction, a flat flushing strip 50' is inserted, as shown in FIG. 9. Flushing strip 50' has a width l7 136, thickness of w6 138 and an overall death of d11 140 is inserted in each female slot 76. Flushing strip 50 is secured with fasteners 78 into threaded bosses 80 having a depth of d12 142 and a width of w8 144, in multiple locations on both sides of flushing strips 50' from one side to the other. Flushing strips 50' transverse to the longitudinal axis for providing maximum flow with low friction. Installing flushing strip 50' will enable the transportation of surface water in the connected system with a very low Manning's coefficient of friction resulting in efficient water flow rates.

Figure 3A:
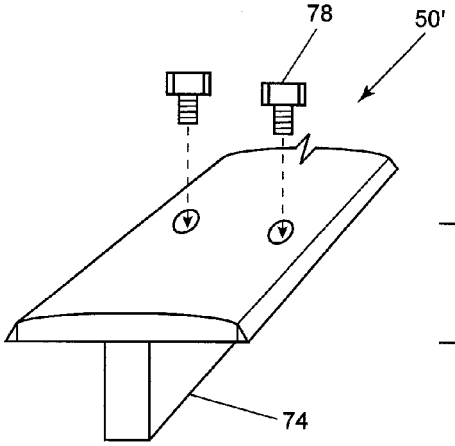
FIG. 3A shows a flushing strip for a low Manning coefficient.
Figure 3B:
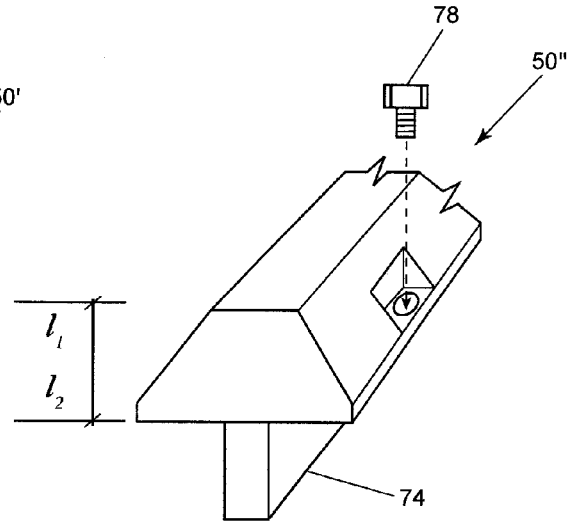
FIG. 3B shows a storm water strip for a high Manning coefficient.
Figure 3C:
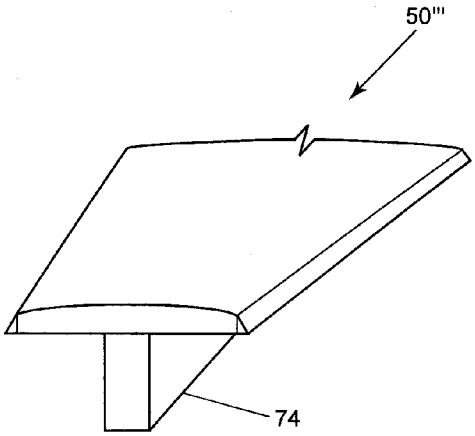
FIG. 3C shows an elbow flushing strip for a low Manning coefficient.
Figure 3D:
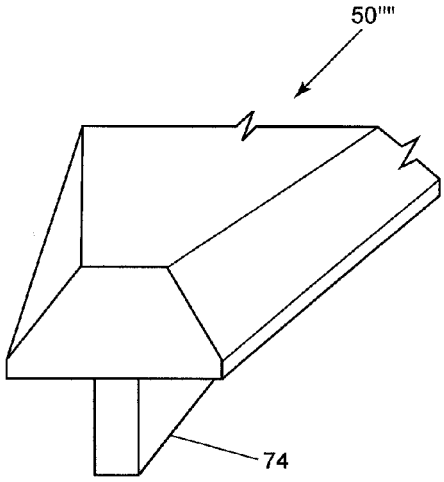
FIG. 3D shows an elbow flushing strip for a high Manning coefficient.

Based on engineering requirements for low efficiency channel flow or high Manning's coefficient of friction for fluid energy dissipation at any given slope, a high Manning effect flushing strip 50" is installed, as shown in FIG. 9. The selection of high Manning flushing strip insert 50" has a width l8 146, thickness of w9 148, and an overall height of h1 150, is inserted in each female slot 76 and secured with fasteners 78 into threaded bosses 80 having a depth of d12 142 and a width of w8 144, in multiple locations on both sides of flushing strips from one side to the other to secure flushing strip 50" in place, installing flushing strip 50" increases the Manning's coefficient of friction significantly which can be used in storm water designs which will provide energy dissipation of flowing surface water eliminating erosion. It is unlikely that a high Manning effect flushing strip and a low Manning effect flushing strip would be utilized in the same liner system. FIG. 9 shows both embodiments of the flushing strips for illustrative purposes only. As shown in FIG. 3C, flushing strip 50'" is a low Manning effect strip for use in the elbow embodiment, discussed below. As shown in FIG. 3D, flushing strip 50"" is a high Manning effect strip for use in the elbow embodiment.

Another new feature disclosed in this document is a unique hold down or mounting mechanism for channel liners 12. This feature is shown in FIGS. 5A, 5B, 6, and 10. The bottom side or underside of channel liner can also have a structural web, such as the honeycomb configuration 40 of FIG. 11 to increase the rigidity of channel liner 12. The end of each channel will also have anchor apertures 152 in slots 66 for the purpose of securing channel liner 12 to existing structures, such as concrete structures 86 with anchor bolts 88. In addition, earth anchors 90 can be embedded in surrounding soil 92 to secure channel liners 12. Self-anchoring tabs 94 can also be inserted into anchoring slots 96 located on the outside of each side section 98 of channel liner, as shown. Self-anchoring tabs 94 having a length l10 100, and depth of d16 102 is inserted into at least two consecutive anchoring slots 96, of depth d15 104 prior to connecting channel sections 12 together in the excavated trench. Anchoring tabs 94 provide self-anchoring with the backfill of earthen material 92 securing channel liner 12 in place. Preferably, erosion control matt 106 should be used. Erosion control matt 106 should extend a minimum of half the depth of the trench and two feet away from top of ditch bank opening and anchored/staked to earth 92 for stability (not shown). Erosion control matt 106 should extend continuously along the ditch bank, parallel to the installation of channel finer 12 to prevent erosion from inclement weather.

Figure 12A:
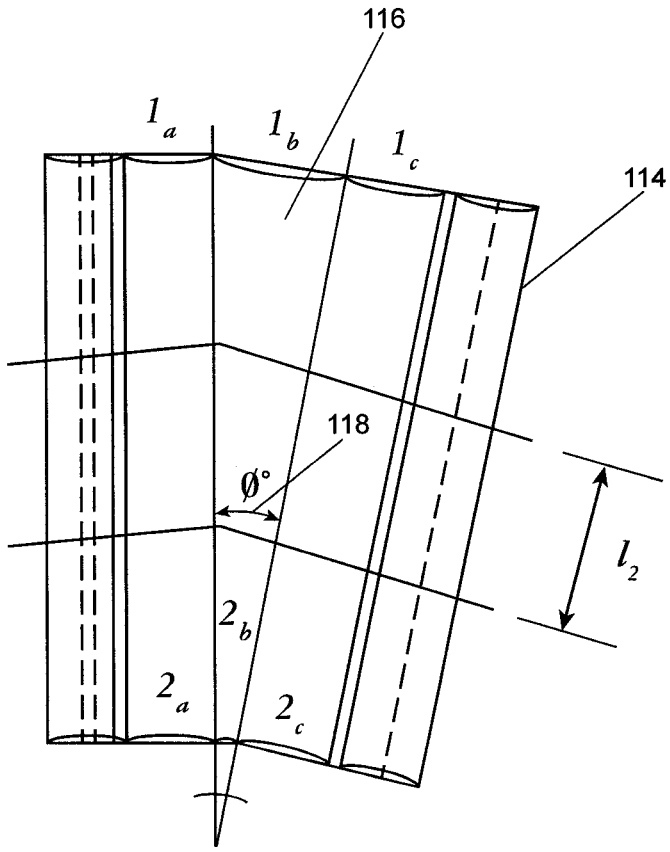
FIG. 12A shows the preferred elbow component.
Figure 12B:
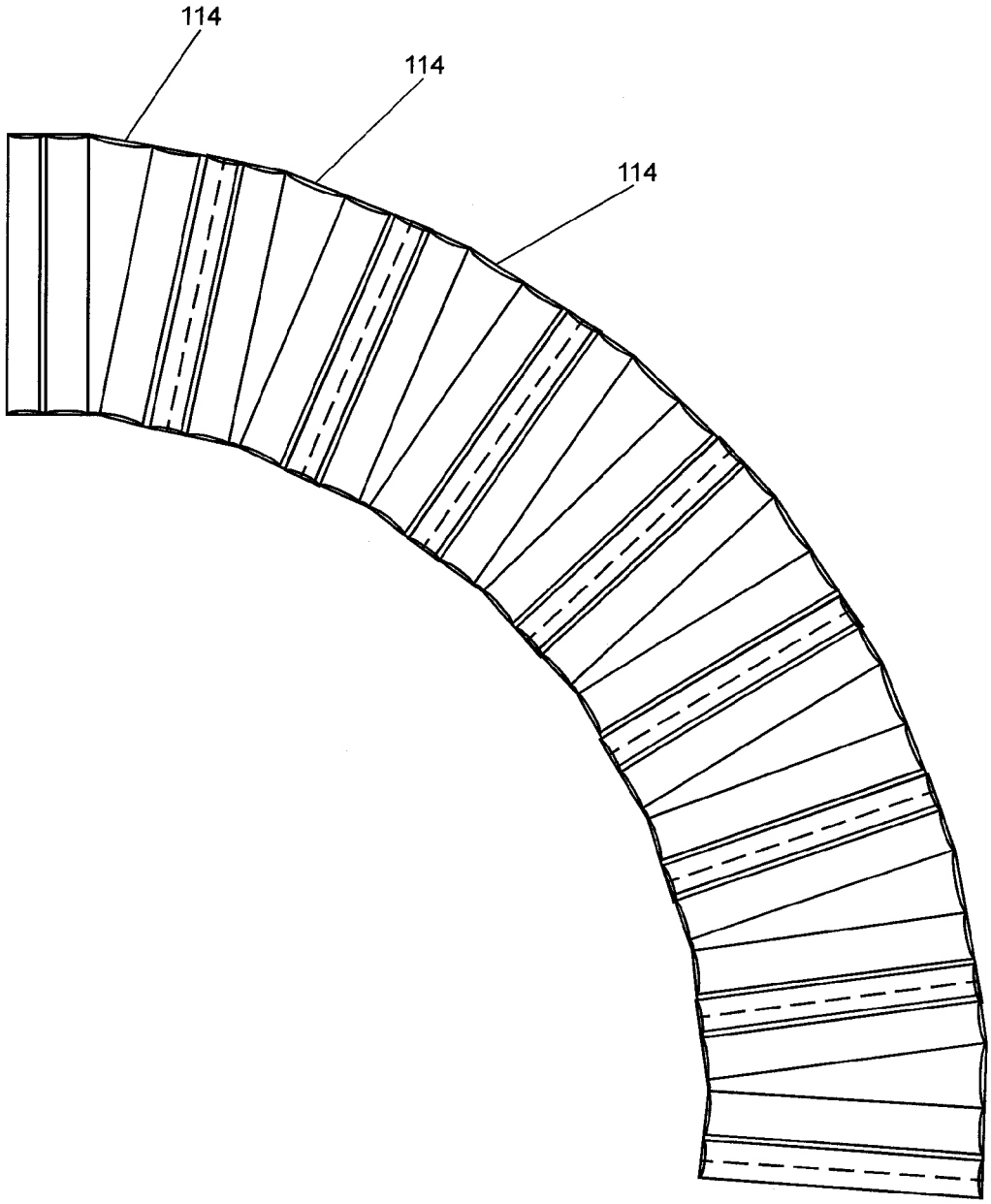
FIG. 12B shows a typical set of elbow components affixed together to change directions of the flow.

The preferred finer system 10 also comprises structural elbows 112 for changing a direction of flow 20. This embodiment is shown in FIGS. 12A and 128. FIG. 12A shows a top view of single elbow section 114. Elbow section 114 is fan shaped which is provided by angled portion 116 in a center of elbow section 114 comprising angle Ø 118. Elbow sections 114 are attached to each other similarly to liner channel sections, as described above. In FIG. 12B, elbow sections 114 each comprise 11¼° elbow, so when two are connected in series, it will result in a 22½° elbow joint. For a 45° elbow joint, four elbow sections 114 are connected in series. Thus, the angle of the direction of flow 20 can be varied by the number of elbow sections 14 that are connected together. Although only 11¼° sections are discussed in this portion, this disclosure is intended to include any angle of elbow section.

Installing or assembling lining system 10 can be accomplished with simple hand tools. Ditch or channel preparation must be completed, including level loop and survey. Lining system 10 can be installed to the dimension designed for and its geometric shape. The ditch or channel should be free of branches debris, rocks, and other sharp objects.

As shown in the drawings, each installation should utilize the slope and flow requirements to select the size of flushing strip or friction strip 50. Once the ditch/channel has been prepped the installation can be completed.

Place erosion control matt 106 on both sides of ditch or channel and anchor to the ground surface 92. Erosion control matt 106 should extend a minimum of half the depth of the trench and two feet away from top of ditch bank opening and anchored or staked to earth 92 for stability. Erosion control matt 106 should extend continuously along the ditch bank, parallel to the installation of the liner system 10 to prevent erosion from inclement weather.

Installation normally requires that a concrete or head wall 86 be installed. Once headwall 86 is in place first channel liner 12' is installed with female end 64 of channel liner section facing upstream and attached to headwall 86 with anchors or fasteners 84 directly into headwall 86 and ensure channel liner is level across the top prior to anchoring.

After first channel liner 12' has been installed, leveled, and anchored, begin the installation of next channel liner 12" in series to include additional channel liners or elbow sections 114 as required (left or right hand) for direction changes.

Elbow sections 114 are designed to make gradual direction changes. It may be required to attach several elbows in series to achieve the change in direction required up to 360°.

Next, depending on the use of liner system 10, a selection of flushing strips 50 is made along with the number of selected flushing strips 50 for the installation. Flushing strip male protrusions 60 are inserted into appropriate female slot guides 72 and bolted via flushing strip bolts 78 into flushing strip threaded apertures.

Although the presently claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A liner system comprising:

a plurality of channel liners connected in series to a predetermined length, each channel liner comprising:

multiple inverted channel beams and multiple channel slots in parallel with inverted channel beams;

a female end comprising a joining slot that runs continuously from end to end, transverse to the longitudinal axis of the channel liner;

a male end comprising a downward facing joining protrusion with a predetermined tolerance configured to fit tightly into the joining slot; and at least one variable height insertable flushing strip corresponding to a predetermined Manning effect, each variable height insertable flushing strip comprising a flushing strip protrusion configured to fit tightly into a channel slot.

2. The liner system of claim 1 wherein each channel liner comprises a trapezoidal cross-section.

3. The liner system of claim 1 wherein each inverted channel beam is concave.

4. The liner system of claim 1 wherein a bottom side of each channel liner comprises a structural honeycomb configuration.

5. The liner system of claim 1 wherein the joining protrusion comprises apertures, and the joining slots comprises threaded apertures and the joining protrusion and joining slots are compressed by joining bolts.

6. The liner system of claim 1 further comprising anchoring apertures and anchoring bolts for anchoring each channel liner to a structure.

7. The liner system of claim 1 further comprising at least two earth anchors for anchoring each liner.

8. The liner system of claim 1 further comprising self-anchoring tabs inserted into anchoring slots on an outside of each side section of each channel liner.

9. The liner system of claim 1 further comprising erosion control mats laid under a portion of each channel liner and away from each channel liner onto a top of a ditch bank opening.

10. The liner system of claim 1 further comprising elbow sections for changing directions of liquid flow.

11. The liner system of claim 10 wherein each elbow section comprises an angled portion in a center comprising angle Ø, at least two inverted elbow channel beams and multiple elbow channel slots in parallel with elbow inverted channel beams.

12. The liner system of claim 10 wherein each elbow section comprises a female end comprising an elbow joining slot that runs continuously from end to end, transverse to the longitudinal axis of the elbow section and an elbow male end comprising a downward facing elbow joining protrusion with a predetermined tolerance configured to fit tightly into the elbow joining slot.

13. A method for constructing a liner system for directing liquids, the method comprising the steps of:

connecting in series a plurality of channel liners to a predetermined length, the step of connecting further comprises inserting a downward facing joining protrusion on a male end of each channel liner into a joining slot that runs continuously from end to end, transverse to the longitudinal axis of the each channel liner, wherein the joining protrusion and the joining slot comprise a predetermined tolerance configured to provide a water tight connection;

diverting a liquid load and supporting loading capabilities from static or dynamic loads from fluids and debris, and other live loads or dead loads via multiple inverted channel beams on the each channel liner; and inserting at least one variable height flushing strip corresponding to a predetermined Manning effect, wherein the step of inserting comprises inserting a flushing strip protrusion on each variable height flushing strip into a channel slot on the each channel liner.

14. The method of claim 13 further comprising supporting a bottom portion of the each channel liner with a structural honeycomb configuration.

15. The method of claim 13 further comprising the step of compressing the joining protrusion and the joining slots.

16. The method of claim 13 further comprising the step of anchoring the each channel liner.

17. The method of claim 16 wherein the step of anchoring comprises inserting self-anchoring tabs inserted into anchoring slots on an outside of each side section of each channel liner and compacting soil onto the inserted tabs.

18. The method of claim 13 further comprising the step of controlling erosion via erosion control mats laid under a portion of the each channel liner and away from the each channel liner onto a top of a ditch bank opening.

19. The method of claim 13 further comprising the step of changing a direction of flow of the liquid by connecting a predetermined number of elbow sections, each elbow section comprising a turning angle Ø, together to a desired angle.

20. The method of claim 19 where in the step of connecting comprises inserting an elbow joining slot that runs continuously from end to end, transverse to the longitudinal axis of the elbow section into an elbow male end comprising a downward facing elbow joining protrusion with a predetermined tolerance configured to fit tightly into the elbow joining slot.

* * * * *